US006447366B1

(12) United States Patent
Ebadian et al.

(10) Patent No.: US 6,447,366 B1
(45) Date of Patent: Sep. 10, 2002

(54) INTEGRATED DECONTAMINATION AND CHARACTERIZATION SYSTEM AND METHOD

(75) Inventors: M. Ali Ebadian, Weston, FL (US); Joseph F. Boudreaux, Oak Ridge, TN (US); Leonel E. Lagos, Hollywood, FL (US)

(73) Assignee: The Board of Regents, Florida International University, Miami, FL (US)

( * ) Notice: Subject to any disclaimer, the term of this patent is extended or adjusted under 35 U.S.C. 154(b) by 0 days.

(21) Appl. No.: 09/629,020

(22) Filed: Jul. 31, 2000

(51) Int. Cl.[7] ..... B24C 9/00
(52) U.S. Cl. ..... 451/2
(58) Field of Search ..... 451/2, 87, 88, 451/39, 75, 76, 92, 447; 209/147, 31, 715, 716

(56) References Cited

U.S. PATENT DOCUMENTS

| | | | | | |
|---|---|---|---|---|---|
| 2,338,591 | A | * | 1/1944 | Learmonth | 29/90.01 |
| 3,654,786 | A | | 4/1972 | Koenecke et al. | 72/53 |
| 3,750,339 | A | | 8/1973 | Barnes | 51/9 |
| 3,824,738 | A | | 7/1974 | Hall et al. | 51/9 |
| 3,835,587 | A | | 9/1974 | Hall, Jr. | 51/9 |
| 3,902,276 | A | | 9/1975 | Jarvis | 51/8 R |
| 4,314,427 | A | | 2/1982 | Stoltz | 51/411 |
| 4,326,362 | A | * | 4/1982 | Williams et al. | 451/80 |
| 4,630,410 | A | * | 12/1986 | Cavada et al. | 376/316 |
| 4,633,623 | A | | 1/1987 | Spitz | 51/439 |
| 4,800,063 | A | * | 1/1989 | Mierswa et al. | 376/310 |
| 5,046,289 | A | | 9/1991 | Bengel et al. | 51/411 |
| 5,239,786 | A | | 8/1993 | Carpenter | 51/411 |
| 5,601,479 | A | * | 2/1997 | Santos | 451/322 |
| 5,690,543 | A | | 11/1997 | Curran | 451/76 |
| 5,749,470 | A | * | 5/1998 | Operschall et al. | 209/147 |
| 6,156,194 | A | * | 12/2000 | Lamoureux | 210/172 |

* cited by examiner

*Primary Examiner*—Joseph J. Hail, III
*Assistant Examiner*—Anthony Ojini
(74) *Attorney, Agent, or Firm*—Marshall Gerstein Borun

(57) ABSTRACT

A system for decontaminating and characterizing a structure is provided in which a decontamination module is used to remove interior and exterior surfaces of the structure. The decontamination module is capable of removing surfaces of interior voids or other structure geometry which is difficult to reach. The contaminated portions of the structure are removed as fragments which are collected in a container for disposal. This system may also include a characterization module for analyzing the structure after grit-blasting. The characterization module develops characterization information which may be used to classify the structure as suitable for reuse, for disposal as low-level contaminated waste, or other categories.

14 Claims, 6 Drawing Sheets

INTEGRATED DECONTAMINATION AND CHARACTERIZATION SYSTEM AND METHOD

FIELD OF THE INVENTION

The present invention generally relates to decontamination methods and apparatus, and more particularly to methods and apparatus for removing contaminated exterior and interior surfaces of large bore pipes and exterior surfaces of structural steel elements.

BACKGROUND OF THE INVENTION

Proper decontamination or disposal of contaminated structures is an ongoing problem. Pipes used in radiological environments, for example, are often exposed to radioactive material, such as uranium, which contaminates the pipe. Consequently, when the contaminated pipe is no longer in use, it must be handled as radioactive waste. Only certain types of sites or disposal cells are suitable for receiving radioactive waste. The disposal cells are expensive to build, and have a limited holding capacity. The limited capacity has created a backlog of radioactively contaminated waste, including pipe, which requires disposal. As more radiologically contaminated sites are deactivated and decommissioned, the backlog is expected to grow significantly.

Unfortunately, structures such as pipes are not efficiently disposed of in disposal cells. If disposed directly in the cell, the pipes create voids in the cell which waste available space and create potentially unstable loading in the cell. To minimize the voids, the pipe may be cut in half or filled with a grout material. Either of these approaches, however, is labor intensive and overly costly to perform, especially when processing large volumes of pipe.

One alternative to direct disposal is to recondition the structures for reuse or disposal as low level radioactive material. This approach has the potential benefit of effectively recycling the structure if it is suitable for reuse, thereby conserving resources. Many regulations applicable to radioactive pipe reconditioning exist which require set quality standards for reconditioned structures. Typically, the reconditioned structures must have a near-white metal finish. As a result, many current surface removing methods and apparatus are not suitable for radioactive pipe reconditioning. It is also important for reconditioning equipment to be portable, so that reconditioning may be performed on site. This requirement eliminates additional known surface removing methods which are not easily transported.

Furthermore, the methods which are portable and provide the necessary finish are often overly cumbersome and difficult to use. When the contaminated structure is a pipe, both an inner surface and an outer surface are often be contaminated. Currently, hand held decontamination tools, such as ROTO PEEN™ scalers, are used to decontaminate outer pipe surfaces. Inner pipe surface decontamination typically requires the use of chemicals to remove the contaminated portions. Conventional pipe reconditioning, therefore, is overly difficult and involves the use, handling, and cleanup of chemicals.

After removing the surfaces of a structure such as a pipe, it must be analyzed to determine the level, if any, of remaining contamination and appropriately characterized. As with surface removal, the geometry of the reconditioned structure may also increase the difficulty of structure characterization. One currently known method of analyzing pipe requires sample readings, or "swipes", to be taken from various surface portions of the structure. The swipes are typically taken in the field and interpreted by a field instrument or taken to a laboratory where the swipes are read by bench top equipment such as liquid scintillation counters. This method is overly costly, and requires a significant amount of turn around time.

SUMMARY OF THE INVENTION

In accordance with certain aspects of the present invention, apparatus is provided for decontaminating a structure having exterior and interior surfaces. The apparatus comprises a housing having an inlet and an outlet and a conveyor extending from the housing inlet to the housing outlet. An exterior surface removing station is disposed inside the housing near a first portion of the conveyor and includes a grit blaster adapted to project an abradant toward the exterior surface of the structure. An interior surface removing station is disposed inside the housing near a second portion of the conveyor and includes a movable blast lance adapted to project an abradant toward the interior surface of the structure. A collection assembly is positioned at a bottom of the housing for collecting spent abradant and removed surface fragments.

In accordance with additional aspects of the present invention, a decontamination and characterization system is provided for decontaminating and characterizing a radioactively contaminated structure having interior and exterior surfaces. The system comprises a decontamination module having a housing with an inlet and an outlet, and a conveyor extending from the housing inlet to the housing outlet. An exterior surface removing station is disposed inside the housing near a first portion of the conveyor, the exterior surface removing station including a grit blaster adapted to project an abradant toward the exterior surface of the structure. An interior surface removing station is disposed inside the housing near a second portion of the conveyor, the interior surface removing station including a movable blast lance adapted to project an abradant toward the interior surface of the structure. A collection assembly is associated with the housing for collecting spent abradant and removed surface fragments. A characterization module is positioned downstream of the decontamination module and has a housing with an inlet and an outlet, and a conveyor extending from the housing inlet to the housing outlet. A material analyzer is positioned inside the housing, the material analyzer detecting radioactive contamination in both the interior and exterior surfaces of the structure and generating contamination data. A computer is electrically connected to the material analyzer for interpreting the contamination data and generating characterization information.

In accordance with further aspects of the present invention, an integrated decontamination and characterization system is provided for decontaminating and characterizing a pipe having an interior surface and an exterior surface. The system comprises a decontamination module having a housing with an inlet and an outlet, and a conveyor extending from the housing inlet to the housing outlet. An exterior surface removing station is disposed inside the housing near a first portion of the conveyor, the exterior surface removing station including a grit blaster adapted to project an abradant toward the exterior surface of the structure. An interior surface removing station is disposed inside the housing near a second portion of the conveyor, the interior surface removing station including a movable blast lance adapted to project an abradant toward the interior surface of the structure, and a collection assembly for collecting spent abradant and removed surface fragments. A characterization module is positioned downstream of the decontamination module and has a housing with an inlet and an outlet, and a conveyor extending from the housing inlet to the housing outlet. A material analyzer is positioned inside the housing, the material analyzer detecting radioactive contamination in both the interior and exterior surfaces of the structure and generating contamination data. A computer is electrically connected to the material analyzer for interpreting the contamination data and generating characterization information. An off-loading module is positioned downstream of the characterization module and has a sorter adapted to receive the characterization information and direct the pipe to a collection point associated with the characterization information. A ventilation module has a housing, a fan disposed in the housing and having an inlet in fluid communication with an interior of the decontamination module housing and an outlet exhausting to atmosphere, and an airborne particulate remover positioned inside the housing and in fluid communication upstream of the fan inlet.

In accordance with still further aspects of the present invention, apparatus is provided for removing an interior surface of a pipe. The apparatus comprises an elevator mechanism positioned to engage and lift an end of the pipe so that the pipe is oriented at an incline angle. A motorized wheel is associated with the elevator mechanism and is adapted to engage an exterior surface of the pipe, the motorized wheel rotating to spin the pipe. A blast lance is supported substantially at the incline angle and movable into the pipe to direct an abradant at the interior surface.

Other features and advantages are inherent in the apparatus claimed and disclosed or will become apparent to those skilled in the art from the following detailed description and its accompanying drawings.

DETAILED DESCRIPTION OF THE PREFERRED EMBODIMENTS

Figure 1:
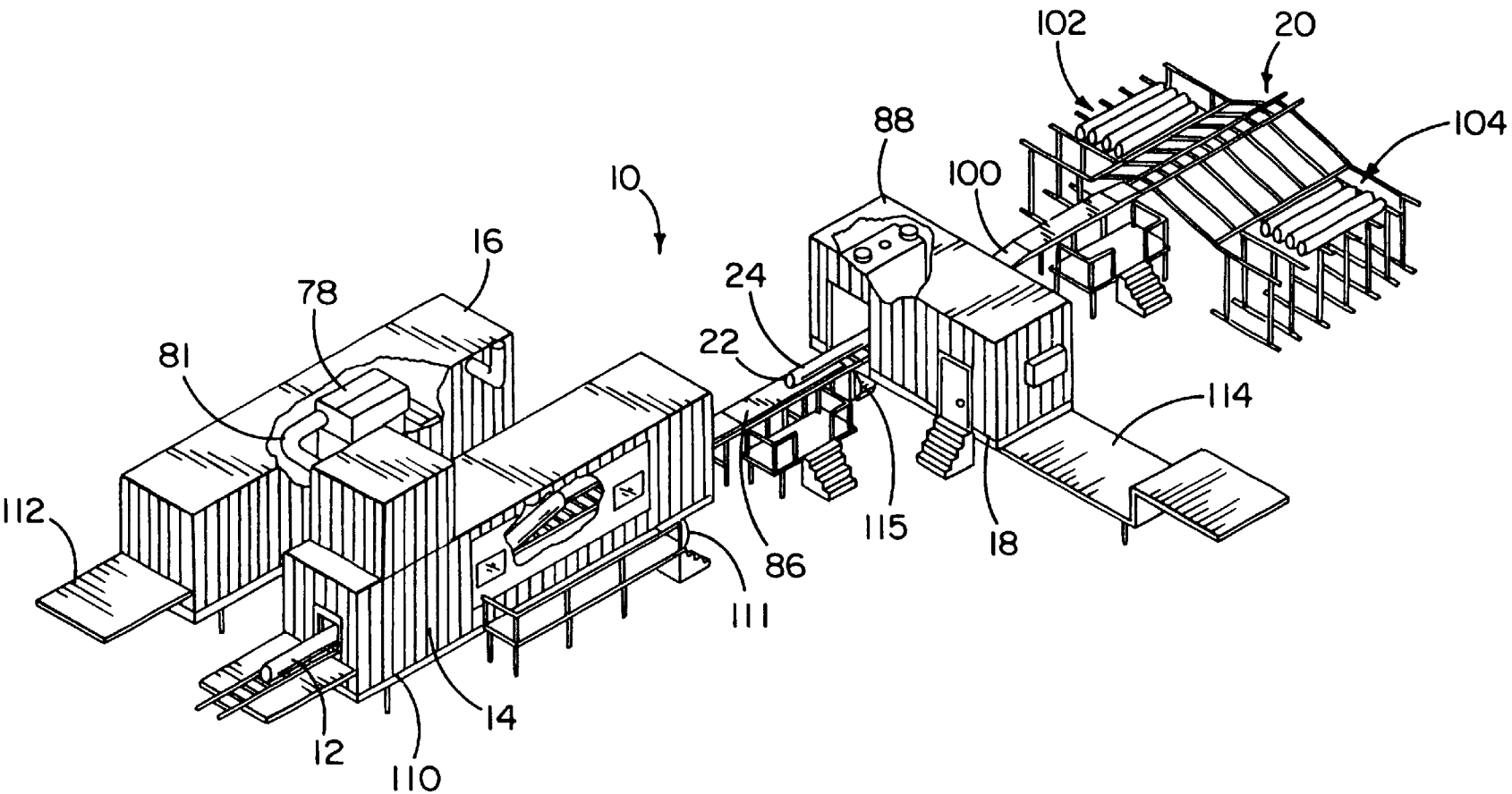
FIG. 1 is a perspective view of an integrated decontamination and characterization system in accordance with present invention.
Figure 2:
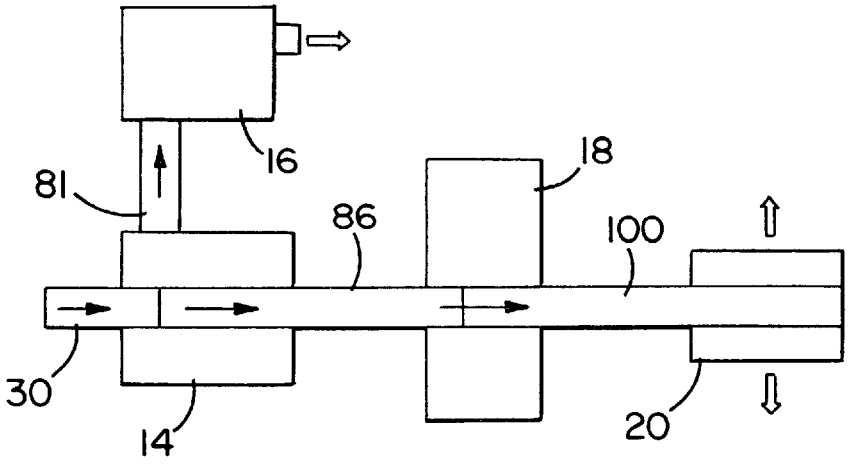
FIG. 2 is a schematic diagram of the integrated decontamination and characterization system illustrated in FIG. 1.

An integrated decontamination and characterization system 10 constructed in accordance with the teachings of the invention is shown generally in FIG. 1 and depicted schematically in FIG. 2. As explained in detail below, the decontamination system is used to process a contaminated structural steel, including pipe 12. The decontamination system 10 comprises a decontamination module 14 which removes external and internal surfaces of the pipe 12 as fragments, a ventilation module 16 for collecting the fragments and spent cleaning media generated by the decontamination module 14, a characterization module 18 which analyzes the level of remaining pipe contamination after the external and internal surfaces are removed, and an off-loading module 20 which segregates the decontaminated pipes or structural steel elements according to information received from the characterization module 18. While the system 10 is illustrated as decontaminating a pipe 12, it will be appreciated that this system 10 is capable of decontaminating structures formed in a wide variety of shapes, such as I-beams, channels, and angles. Furthermore, it will be appreciated that the decontamination module 14 may be used alone to decontaminate a structure, or may be used with one or more of the other modules as needed for a particular application.

Figure 4:
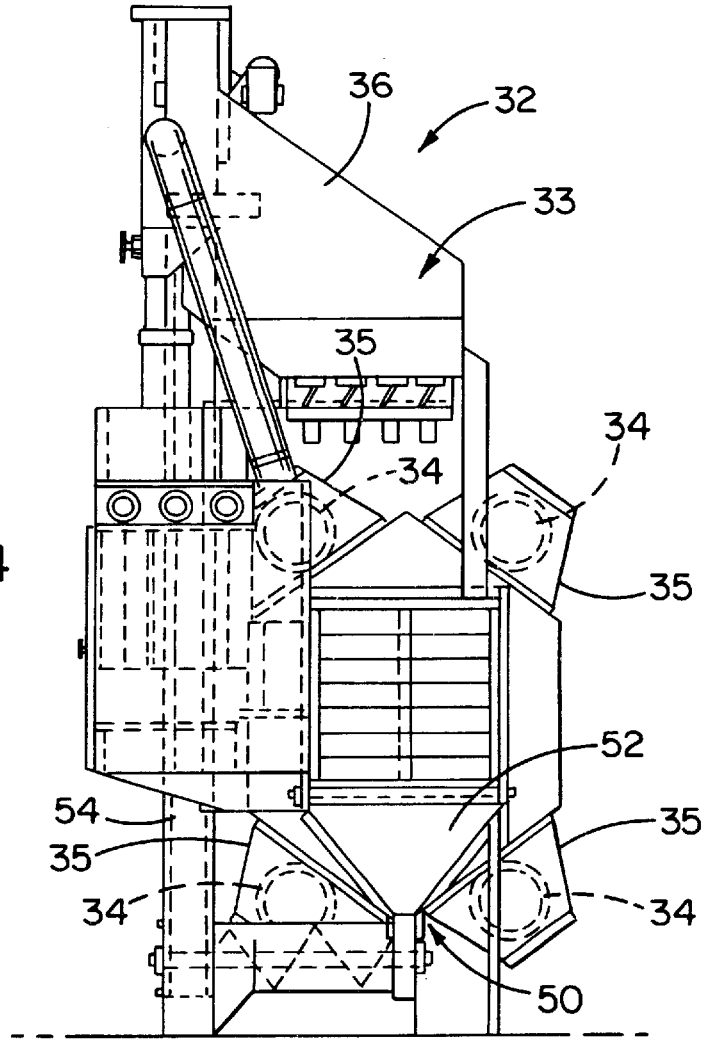
FIG. 4 is an end view of a grit blaster and bucket elevator used in the decontamination module taken along line 4—4 of FIG. 3.
Figure 3:
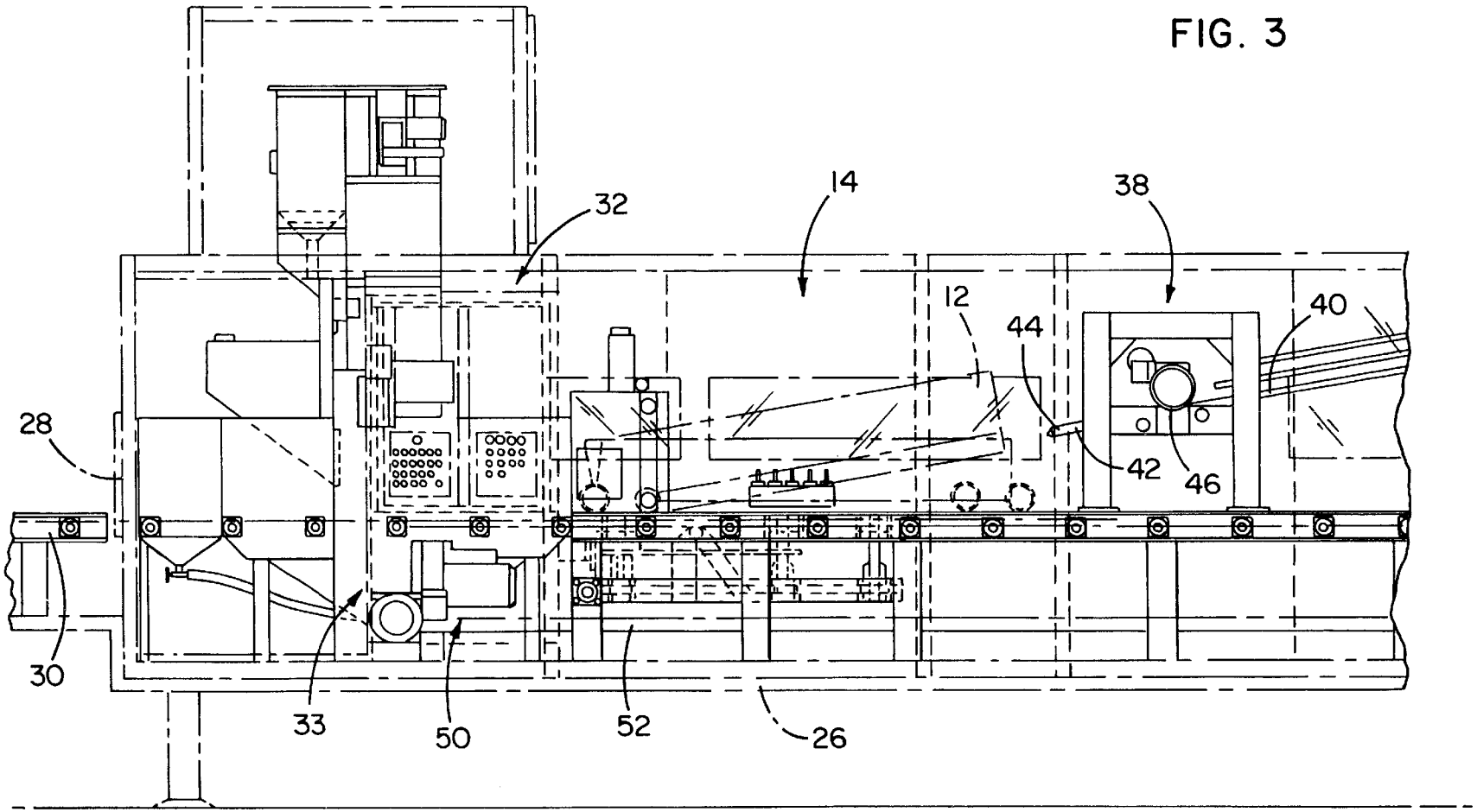
FIG. 3 is a side elevation view of a portion of a decontamination module incorporated into the integrated decontamination and characterization system.

The decontamination module 14 is provided for removing the exterior surfaces of the pipe 12. It will be understood that a structure such as the pipe 12 has both an inner surface 22 and an outer surface 24 (FIG. 1). Accordingly, the decontamination module 14 includes an outer surface removing station 32 and an inner surface removing station 38. As illustrated in FIG. 3, the decontamination module 14 has a housing 26 defining an inlet 28. The outer surface removing station 32 is disposed inside the housing 26 and removes the outer surface 24 of the pipe 12. In the illustrated embodiment, the outer surface station comprises an abradant projector, such as a centrifugal grit blaster 33. An inlet conveyer 30 extends through the inlet 28 of the housing 26 to the grit blaster 33. The grit blaster 33 comprises four centrifugal blasting wheels 34 arranged about the inlet conveyer 30 (FIG. 4). Each blasting wheel 34 has an outlet director 35 for directing an abradant, such as steel shot or grit, toward the desired target. A hopper 36 is provided for loading the abradant into the blasting wheels 34.

In operation, each blasting wheel 34 projects the abradant toward the outer surface 24 of the pipe 12 as the pipe advances downstream along the inlet conveyer 30. The outer surface is abraded so that a layer of the pipe 12 is removed in fragments. In addition, any foreign material, such as paint, dirt, or grease, is also removed. The pipe fragments will range in size from small chunks or flakes to dust-sized granules, and will include foreign matter removed from the pipe such as chips of paint and dirt.

The inner surface removing station 38 is located inside the housing 26 and downstream of the outer surface removing station 32. In the preferred embodiment, the inner surface removing station 38 includes a blast lance 40 for directing the abradant toward the inner surface 22 of the pipe 12. As illustrated in FIG. 3, the blast lance 40 comprises an elongate conduit 42 having a nozzle 44 attached to one end. The conduit 42 is connected to a supply of abradant (not shown), and a supply of pressurized air (not shown). A drive 46 engages the conduit 42 to selectively extend or retract the nozzle 44.

Figure 8:
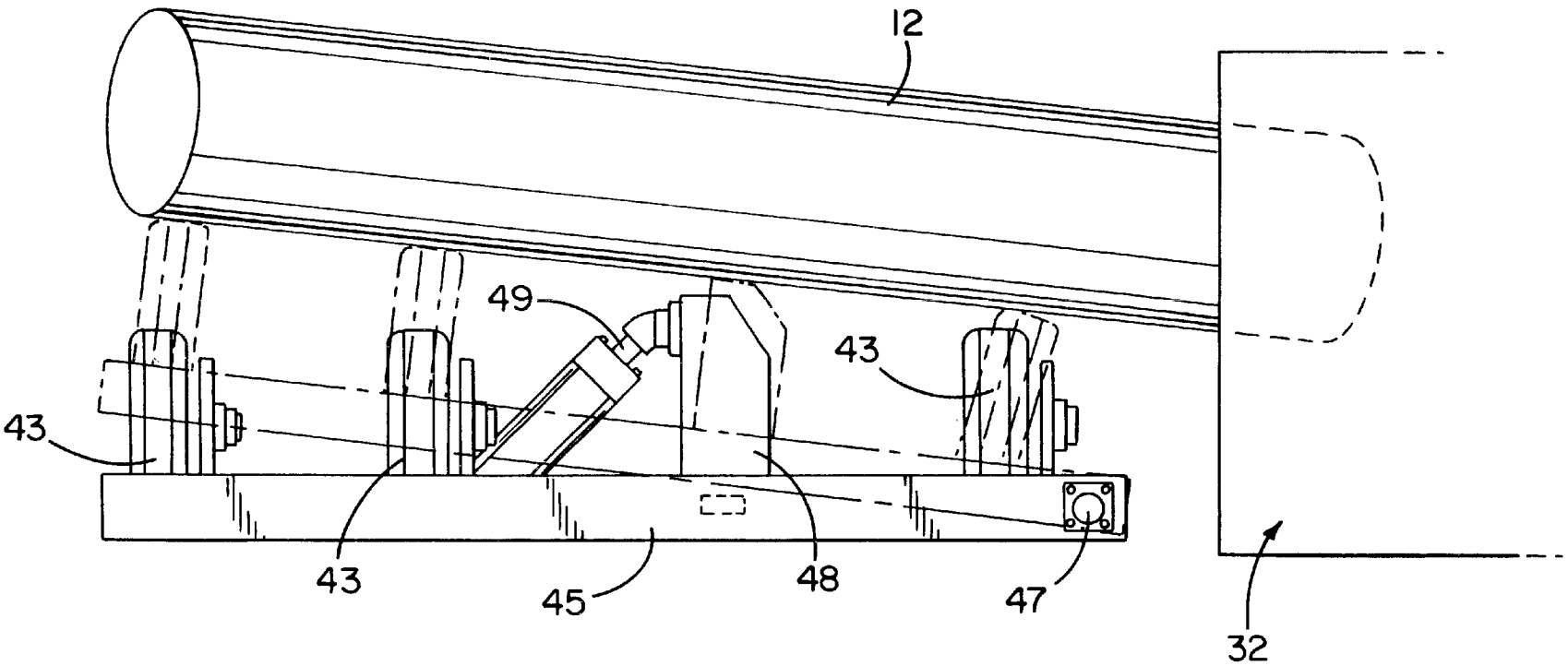
FIG. 8 is a partially schematic side view of a lifting table incorporated into the integrated decontamination and characterization system.

The inner surface removing station 38 also includes a lifting table 41 for raising an end of the pipe 12 and means for rotating the pipe 12. The lifting table 41 includes a bed 45 supported for pivoting movement about a hinge 47. A mast 48 is attached to the bed 45, and a hydraulic piston 49 engages the mast 48. The rotating means preferably comprises three pairs of 12-inch diameter rubber wheels 43 supported on the bed 45 and rotatably driven by a motor (not shown). In operation, as the pipe 12 nears the blast lance 40, the hydraulic piston 49 extends to raise the bed 45, thereby elevating one end of the pipe 12. As a result, the pipe is oriented at an angle (preferably forty five degrees) with respect to horizontal, as shown in phantom lines in FIG. 8. The rubber wheels 43 are then compressed against the pipe 12 and rotated to spin the pipe 12.

As the angled pipe 12 spins, the drive 46 is actuated to advance the nozzle 44 into the pipe 12. As the nozzle 44 enters the pipe 12, the abradant is pressurized and discharged from the nozzle 44 toward the inner surface 22 of the pipe 12. The nozzle 44 advances from a leading edge of the pipe 12 to a trailing edge so that the entire inner surface 22 is abraded, thereby removing a layer of the inner surface 22 in the form of pipe fragments. Once the trailing edge of the pipe 12 has been reached, the drive 46 is reversed to retract the nozzle 44 out from the pipe 12. In a preferred embodiment, a small ball bearing guide is used to ensure that the lance assembly touches the bottom interior surface of the pipe 12 being decontaminated. To help clear the pipe 12 of any abradant or pipe fragments settling inside the pipe, the supply of abradant may be shut off as the nozzle is retracted and pressurized air may be discharged from the nozzle 44, thereby blowing any material, such as grit, from inside the pipe 12 and out the trailing end.

The decontamination module 14 further includes a collector 50 for accumulating and transporting spent abradant and pipe fragments. As best shown in FIGS. 3 and 4, the collector 50 comprises a screw drive conveyor 52 positioned inside the housing 26 and extending along the length of the decontamination module 14, below the grit blaster 32 and blast lance 40. The screw drive conveyer 52 pushes steel grit toward the front of the decontamination module 14 to a collection point where the grit is picked up by a rotating belt bucket elevator 54. The bucket elevator 54 carries the steel grit upward and discharges the spent grit into the hopper 36 for supplying abradant to the grit blaster 33 and the blast lance 40.

During operation of the decontamination module 14, spent abradant and pipe fragments fall into the screw drive conveyor 52. The abradant and pipe fragments are advanced by the screw drive conveyer 52 to the bucket elevator 54. The bucket elevator 54 carries the material vertically upward for discharge into the hopper 36.

Figure 5:
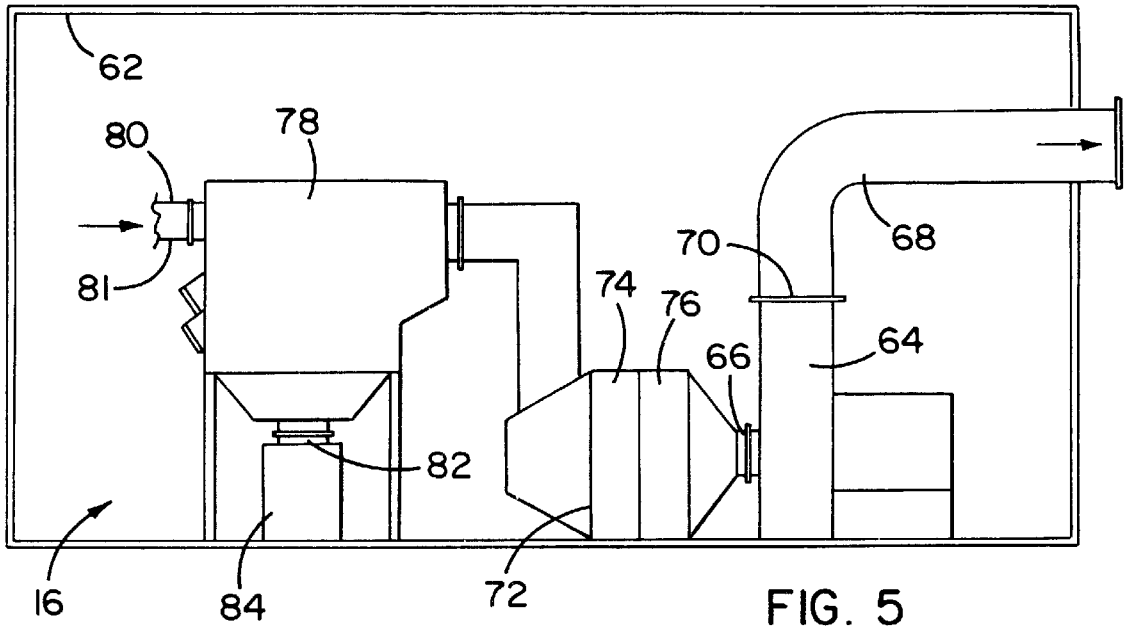
FIG. 5 is a side elevational view of a ventilation module incorporated into the integrated decontamination and characterization system.

The ventilation module 16 is provided to collect pipe fragments and any airborne particulates created in the decontamination module 14. As illustrated in FIG. 5, the ventilation module 16 is preferably housed inside a strong tight container 62 designed for transportation of radiologically contaminated waste. The ventilation module 16 includes a cyclone separator 78 for separating the pipe fragments from the dust. The cyclone separator 78 has an inlet 80 connected to the housing 26 of the decontamination module 14 by a duct 81, and a bottom outlet 82 connected to a drum 84 for collecting separated particulates. A filter housing 72 is connected downstream of the separator 78 and houses at least one, and preferably four, roughing filter 74 and at least one, and preferably four, nuclear-grade HEPA filter 76. In a preferred embodiment, the filter housing 72 is preferably provided with reverse air pulsing capability. A fan 64 has an inlet 66 connected to the filter housing 72 and an outlet 70. An outlet duct 68 is connected to the outlet 70 of the fan for exhausting air flow outside of the container 62.

When the ventilation module 16 is operated, the fan 64 creates an air flow through the hopper 36, which separates the pipe fragments from the heavier abradant material. The air flow carries the pipe fragments and dust away without removing the abradant material. The air stream laden with pipe fragments and dust passes through the cyclone separator 78 which causes the heavier pipe fragments to drop out of the air stream and into the drum 84, but the dust continues to flow to the filter housing 72. The filters 74, 76 disposed in the filter housing 72 remove the dust and other lighter materials from the air stream. The air stream, from which the pipe fragments and dust have been removed, continues through the fan 64 and exhausts through the outlet duct 68. As a result, the ventilation module 16 not only collects the pipe fragments in readily disposable containers, but also allows the abradant to be reused. In addition, the ventilation module 16 maintains the decontamination module 14 under negative pressure. As a result, the surface removing process is entirely contained, thereby enhancing safety, particularly when the system 10 processes radioactively contaminated structures.

Figure 6A:
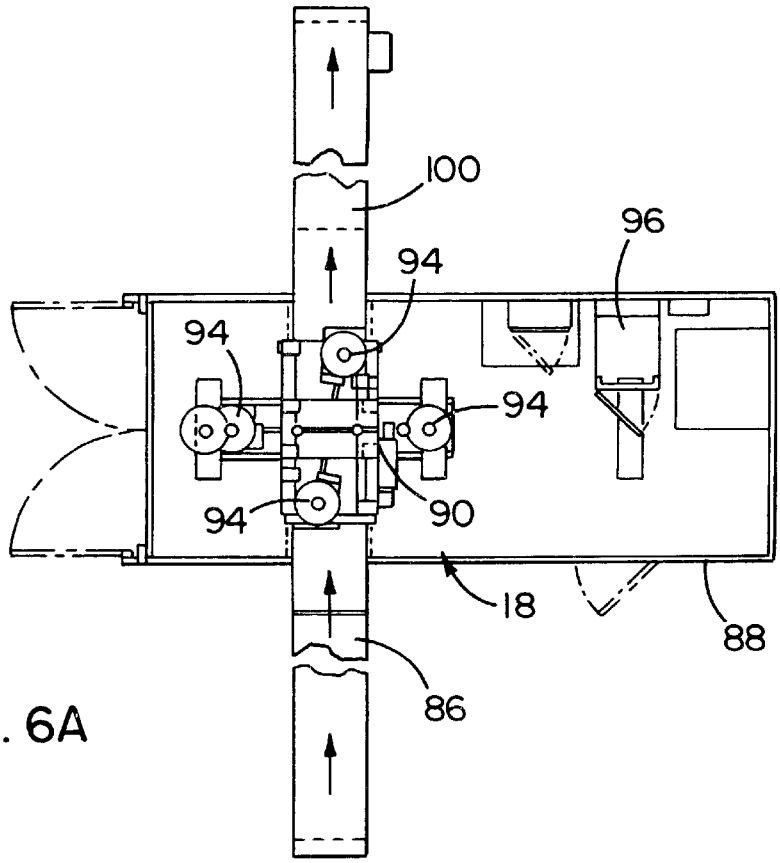
FIG. 6A is a plan view of a characterization module incorporated into the integrated decontamination and characterization system.
Figure 6B:
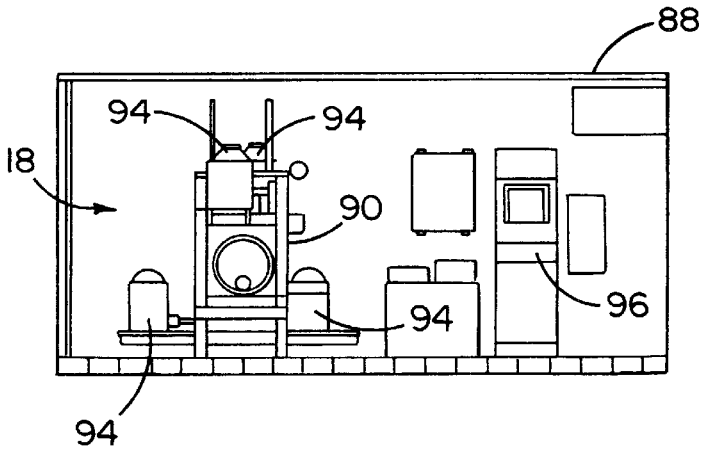
FIG. 6B is a side elevation view of the characterization module illustrated in FIG. 6A.
Figure 7:
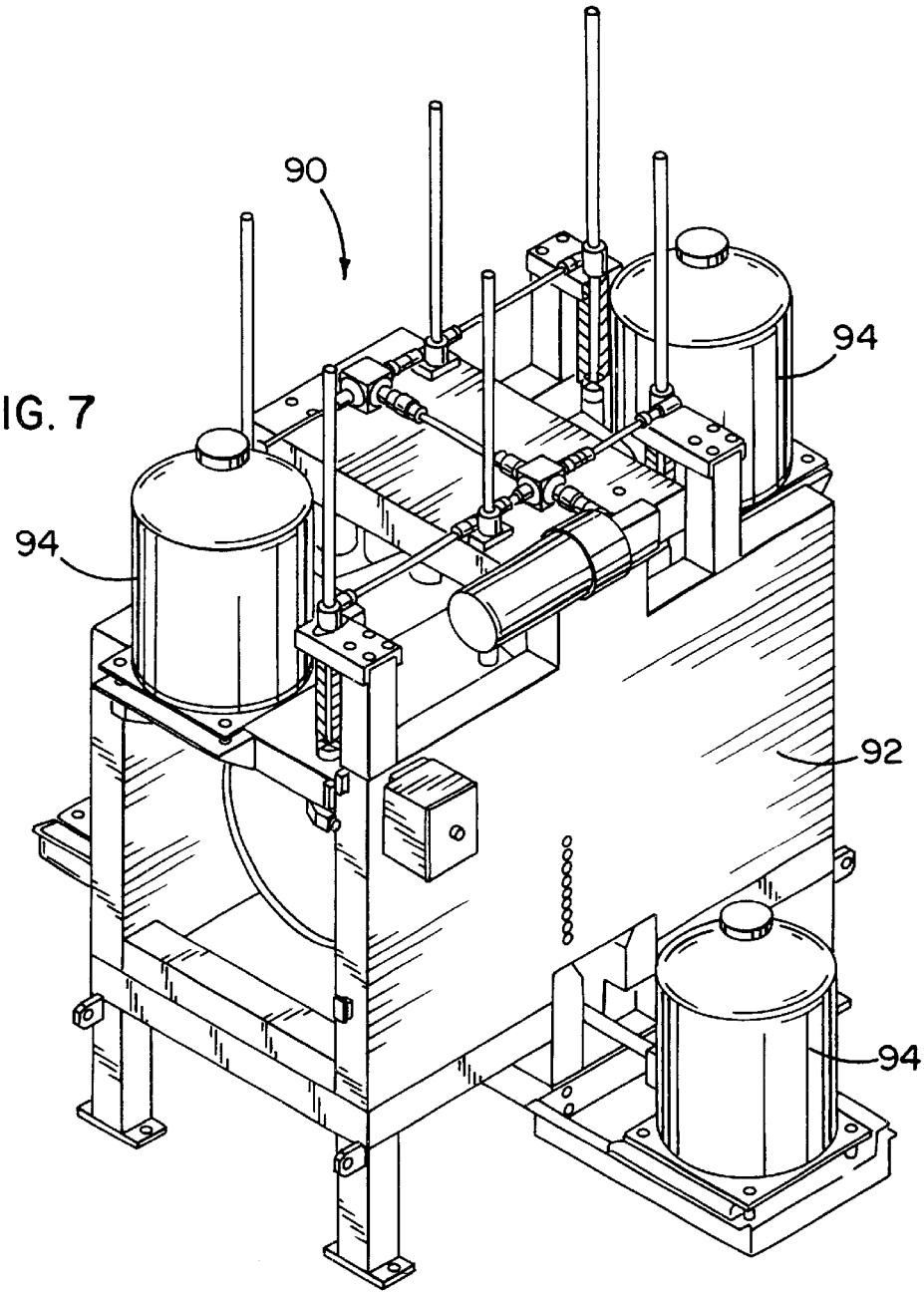
FIG. 7 is a perspective view of a shield and detectors used in the characterization module illustrated in FIGS. 6A and B.

In the preferred embodiment, the characterization module 18 is located downstream of the decontamination module 14 for analyzing the remediated pipe 12. A transfer conveyer 86 extends from an outlet of the decontamination module 14 to an inlet of the characterization module 18. The characterization module 18 is housed in a strong tight container 88 (FIGS. 6A and 6B) and includes a material analyzer 90 (FIG. 7). The material analyzer 90 includes a housing 92 which supports four characterization detectors 94. The detectors 94 positioned about the housing 92 to analyze contamination levels at specific portions of the pipe 12, such as at the top, bottom, and both sides of the pipe 12, with the top and side detectors 94 adjustable to accommodate pipes of various sizes. Computer hardware and software 96 are attached to the material analyzer to collect feedback. In the preferred embodiment, the detectors 94 comprise broad energy Germanium detectors which measure gamma radiation emitted from different radionuclides. The Germanium detectors allow for low and high-energy photons to be measured with a single detector. Each detector 94 covers a known surface area, such as one square meter, and therefore each pipe 12 may be measured in sections based on the coverage area. The detectors 94 may be programmed to measure internal, external, and internal/external contamination.

The computer hardware and software 96 preferably includes computer-controlled ICG NIM counting electronics and automated software, such as Genie-2000™ software marketed by Canberra of Meridan, Conn., for controlling the entire system. The software analyzes data received from the detectors 94 and uniquely identifies and quantifies radionuclides that are present. Each radionuclide is quantified individually, then compared to release limits established by government regulations. For example, specific ranges may be identified such that a pipe having a reading in one range is classified as suitable for unrestricted reuse, while a pipe having a reading in another range is classified as suitable for disposal as low-level radioactive waste.

A pipe or material marker (not shown) may be used downstream of the characterization module 18 to mark each pipe 12 with an identifier.

The off-loading module 20 is provided downstream of the characterization module 18 for segregating the pipe 12 according to the characterization information assigned to the pipe. As best illustrated in FIG. 1, an outlet conveyer 100 transfers the pipe 12 from an outlet of the characterization module 18 to the off-loading module 20. The off-loading module is associated with first and second collection points 102, 104 which correspond to classifications assigned by the classification module 18. For example, the first collection point 102 may correspond to pipes classified as suitable for unrestricted reuse, while the second collection point 104 corresponds to pipes classified as suitable for disposal as low level radioactive waste. In operation, the off-loading module 20 is provided with the characterization information and directs the pipe to the appropriate collection point.

In a highly preferred embodiment, the decontamination module 14, ventilation module 16, and characterization module 18 are portable for easy transport to a desired remediation site. As best illustrated in FIG. 1, the housing 26 of the decontamination module 14 is sized to be placed on a standard trailer bed 110 having wheels 111. Similarly, the ventilation module 16 is supported by a standard sized trailer bed 112 having wheels (not shown), and the characterization module 18 is attached to a trailer bed 114 having wheels 115. During transport, the off-loading module 20 is also mounted on a trailer bed (not shown). Trucks may be attached to the trailer beds 110, 112, 114 to position the system 10 on site or to move the system 10 to a new site.

In accordance with additional aspects of the present invention, a method of recycling a structure is provided. According to the method, a structure, such as the pipe 12, is placed inside the enclosure 26 of the decontamination module 14 and the abradant is projected at the surface of the structure. In the illustrated embodiment, the pipe 12 first passes through the outer surface removing station 32, which comprises a grit blaster 33 for removing the outer surface 24 of the pipe 12 in fragments. An inner surface removing station 38, comprising a blast lance 40, then projects abradant at the inner surface 22 to remove additional pipe fragments. The fragments accumulate in the collector 50, which transports the fragments to a discharge opening 56. An air stream produced by the ventilation module 16 separates the pipe fragments from the steel grit. The heavier pipe fragments are separated from the air stream by the cyclone separator 78 to be collected in the drum 84, while the lighter fragments are collected in a series of filters 74, 76. The method preferably includes a characterization step after the abradant projecting step. During the characterization step, the pipe 12 is analyzed in the characterization module 18 to determine the contamination level remaining in the pipe.

From the above, it will be appreciated that the present invention brings to the art a new and improved integrated decontamination and characterization system for processing contaminated structures. The system includes a decontamination module which removes the inside and outside surfaces of the structure as fragments. The heavier fragments are collected in containers which are easily disposed of at approved waste sites. Lighter fragments are collected in a series of filters which are also easily disposed. The system also includes a characterization module which analyzes the structure and provides characterization information regarding the level of contamination remaining in the structure. An off-loading module is also preferably provided which uses the characterization information to sort the structures according to the classifications assigned in the characterization module.

The system of the present invention therefore converts the contaminated portions of a structure, which may have a geometry which creates voids in the disposal cell, into contaminated structure fragments which are collected in containers and filters having a more suitable geometry for disposal. In addition, by removing only the contaminated portions of the structure, the pipe may be conditioned for reuse, thereby conserving resources. By including a characterization module, the decontamination system is capable of immediately determining whether a structure is suitable for reuse.

Moreover, persons of ordinary skill in the art will recognize that, although certain embodiments of the teachings of the invention have been described herein, the scope of coverage of this patent is not limited thereto. On the contrary, this patent covers all instantiations of the teachings of the invention fairly fall within the scope of the appended claims either literally or under the doctrine of equivalents.

What is claimed is:

1. A decontamination and characterization system for decontaminating and characterizing a radioactively contaminated structure having interior and exterior surfaces, the system comprising:

a decontamination module having a housing with an inlet and an outlet, a conveyor extending from the housing inlet to the housing outlet, an exterior surface removing station disposed inside the housing near a first portion of the conveyor, the exterior surface removing station including a grit blaster projecting an abradant toward the exterior surface of the structure, an interior surface removing station disposed inside the housing near a second portion of the conveyor, the interior surface removing station including a movable blast lance projecting an abradant toward the interior surface of the structure, and a collection assembly for collecting spent abradant and removed surface fragments; and a characterization module positioned downstream of the decontamination module and having a housing with an inlet and an outlet, a conveyor extending from the housing inlet to the housing outlet, a material analyzer positioned inside the housing, the material analyzer detecting radioactive contamination in both the interior and exterior surfaces of the structure and generating contamination data, and a computer electrically connected to the material analyzer for interpreting the contamination data and generating characterization information.

2. The system of claim 1, in which the material analyzer includes a plurality of detectors responsive to radiation emitted from the structure.

3. The system of claim 2, in which each detector comprises a broad energy Germanium detector responsive to gamma radiation emitted from radionuclides.

4. The system of claim 1, in which the computer includes software for comparing the contamination data to stored release limits to generate the characterization information.

5. The system of claim 1, further comprising a ventilation assembly having a housing, a fan disposed in the housing and having an inlet in fluid communication with an interior of the decontamination module housing and an outlet exhausting to atmosphere, and an airborne particulate remover positioned inside the housing and in fluid communication upstream of the fan inlet.

6. An integrated decontamination and characterization system for decontaminating and characterizing a pipe having an interior surface and an exterior surface, the system comprising:

a decontamination module having a housing with an inlet and an outlet, a conveyor extending from the housing inlet to the housing outlet, an exterior surface removing station disposed inside the housing near a first portion of the conveyor, the exterior surface removing station including a grit blaster projecting an abradant toward the exterior surface of the structure, an interior surface removing station disposed inside the housing near a second portion of the conveyor, the interior surface removing station including a movable blast lance projecting an abradant toward the interior surface of the structure, and a collection assembly for collecting spent abradant and removed surface fragments;

a characterization module positioned downstream of the decontamination module and having a housing with an inlet and an outlet, a conveyor extending from the housing inlet to the housing outlet, a material analyzer positioned inside the housing, the material analyzer detecting radioactive contamination in both the interior and exterior surfaces of the structure and generating contamination data, and a computer electrically connected to the material analyzer for interpreting the contamination data and generating characterization information;

an off-loading module positioned downstream of the characterization module for receiving the characterization information and directing the pipe to a collection point associated with the characterization information; and a ventilation module having a housing, a fan disposed in the housing and having an inlet in fluid communication with an interior of the decontamination module housing and an outlet exhausting to atmosphere, and an airborne particulate remover positioned inside the housing and in fluid communication upstream of the fan inlet.

7. The system of claim 6, in which the grit blaster comprises a plurality of centrifugal blasting wheels.

8. The apparatus of claim 6, in which the interior surface removing station includes a lifting table positioned to engage an end of the structure, the lifting table being movable to an elevated position so that the structure is oriented at an incline angle, wherein the blast lance is oriented at substantially the incline angle.

9. The apparatus of claim 8, in which the interior surface removing station further comprises a motorized wheel for rotating the structure.

10. The apparatus of claim 6, in which the collection assembly includes screw drive conveyor.

11. The apparatus of claim 10, in which the grit blaster includes a loading hopper, and in which the collection assembly further includes a bucket elevator positioned to receive the spent abradant from the screw drive conveyor and discharge the spent abradant into the loading hopper.

12. The system of claim 6, in which the material analyzer includes a plurality of detectors responsive to radiation emitted from the structure.

13. The system of claim 12, in which each detector comprises a broad energy Germanium detector responsive to gamma radiation emitted from radionuclides.

14. The system of claim 6, in which the computer includes software for comparing the contamination data to stored release limits to generate the characterization information.

* * * * *